US006849848B2

(12) United States Patent
Baranov et al.

(10) Patent No.: US 6,849,848 B2
(45) Date of Patent: Feb. 1, 2005

(54) METHOD AND APPARATUS FOR COOLING AND FOCUSING IONS

(75) Inventors: Vladimir I. Baranov, Richmond Hill (CA); Alexandre V. Loboda, Toronto (CA); Christopher M. Lock, Richmond Hill (CA)

(73) Assignee: MDS, Inc., Concord (CA)

( * ) Notice: Subject to any disclaimer, the term of this patent is extended or adjusted under 35 U.S.C. 154(b) by 85 days.

(21) Appl. No.: 10/244,460

(22) Filed: Sep. 17, 2002

(65) Prior Publication Data

US 2003/0080290 A1 May 1, 2003

Related U.S. Application Data

(60) Provisional application No. 60/322,420, filed on Sep. 17, 2001.

(51) Int. Cl.[7] ..... H01J 49/10
(52) U.S. Cl. ..... 250/288; 250/282
(58) Field of Search ..... 250/288, 282, 250/423 R, 425

(56) References Cited

U.S. PATENT DOCUMENTS

| | | | | |
|---|---|---|---|---|
| 4,963,736 A | | 10/1990 | Douglas et al. | |
| 5,248,875 A | * | 9/1993 | Douglas et al. | 250/282 |
| 6,111,250 A | * | 8/2000 | Thomson et al. | 250/282 |
| 6,175,112 B1 | * | 1/2001 | Karger et al. | 250/288 |
| 6,462,336 B1 | * | 10/2002 | Bajic | 250/288 |
| 6,534,764 B1 | * | 3/2003 | Verentchikov et al. | 250/287 |
| 2002/0121594 A1 | * | 9/2002 | Wang et al. | 250/281 |

FOREIGN PATENT DOCUMENTS

| | | |
|---|---|---|
| GB | 2348049 | 3/2000 |
| WO | WO 99/38185 | 7/1999 |
| WO | WO 00/77822 | 12/2000 |
| WO | WO 00/77823 | 12/2000 |

OTHER PUBLICATIONS

A.V. Loboda, A.N. Krutchinsky, M. Bromirski, W. Ens and K.G. Standing A tandem quadrupole/time–of–flight mass spectrometer with a matrix–assisted laser desorption/inionization source: design and performance.

* cited by examiner

*Primary Examiner*—John R. Lee
*Assistant Examiner*—James J. Leybourne
(74) *Attorney, Agent, or Firm*—Bereskin & Parr

(57) ABSTRACT

Collisional cooling of ions in mass spectrometry has been known for sometime. It is known that collisional cooling can promote focusing of ions along the axis of an ion guide. A similar technique has been used to enhance coupling of a pulsed ion source such as a MALDI source to a Time of Flight instrument. It is now realized that it is desirable to provide, immediately adjacent to a MALDI or other ion source, a low-pressure region to promote ionization conditions most favorable for the particular ion source. Then, with the ions released and free, the ions are subjected to relatively rapid collisional cooling in a high pressure region adjacent to the ionization region. This will dissipate excess of internal energy in the ions, so as to substantially reduce the incidence of metastable fragmentation of the ions. The ions can then be subjected to conventional mass analysis steps.

48 Claims, 8 Drawing Sheets

METHOD AND APPARATUS FOR COOLING AND FOCUSING IONS

This application claims the benefit of U.S. Provisional Application No. 60/322,420, filed Sep. 17, 2001, the entire content of which is hereby incorporated reference.

FIELD OF THE INVENTION

This invention relates to mass spectrometry. This invention more particularly relates to generation of ions with an ion source that produces internally excited or "hot" ions like MALDI (Matrix Associated Laser Desorption Ionization), and the problems of unwanted or premature fragmentation of ions.

BACKGROUND OF THE INVENTION

Collision cooling of ions is now widely used for the purpose of improving the quality of the ion beams. Cooling can be accomplished in an RF only ion guide as disclosed in U.S. Pat. No. 4,963,736 to Douglas, et al. or in gas chamber, that do not include RF rods. Both these techniques provide a buffer gas, and the presence of the buffer gas slows down the ions and, in the case of the RF-ion guide, can lead to reduction of the size of the ion beam. The process may also cool down internal vibration and other degrees of freedom of the ions.

In some cases the ions acquire a high degree of internal excitation during ionization or other processes. If left excited, the ions will eventually fragment; this process is called metastable fragmentation. Metastable fragmentation is one of the main reasons for poor quality spectra of large proteins and DNAs using MALDI (See, for example, A. V. Loboda, A. N. Krutchinsky, M. Bromirski, W. Ens, K. G. Standing, "A tandem quadrupole/time-of-flight mass spectrometer (QqTOF) with a MALDI source: design and performance", *Rapid Commun. Mass Spectrom.* 14, 1047 (2000))]. Some other ionization methods (surface ionization mass spectrometry SIMS, fast atom bombardment FAB, Laser ablation LA, electron impact EI, etc) have similar problems and the present invention is generally applicable to such other methods. However, the present invention is primarily intended for application to MALDI sources and the invention will be described primarily in relation to MALDI sources. Metastable fragmentation means that ions can spontaneously fragment at any time and at any location in a mass spectrometer instrument, and hence can give poor spectra.

Because of this limitation, two types of axial MALDI TOF (Time of Flight) systems now exist on the market: linear MALDI TOF and reflectron MALDI TOF. In a linear MALDI TOF, ions are pulsed from an extraction region into a linear flight tube, and the ions are detected at the end of the flight tube. The time of flight through the flight tube depends upon the initial energy given to the ions in the extraction region and the ions' mass to charge ratio. As ions have some energy and velocity before the extraction pulse is applied, this motion is reflected in the velocity of ions m/z ratio as they travel through the flight tube. The overall effect is to degrade the resolution and accuracy of a linear time of flight instrument. For this reason, reflectron MALDI TOF instruments were developed. In a reflectron MALDI TOF, ions are again pulsed out of an extraction region and are provided with a pulse of energy. However, after traveling through the first part of the flight tube, the ions enter a reflection region where a field is applied to reflect the ions back to a location beside the original extraction region. The overall effect, approximately, is to negate or at least reduce the effect of any original ion motion in the direction of ion travel, so that reflectron TOF instruments have excellent resolution and mass accuracy.

Because of the different characteristics of linear and reflectron TOF instruments, metastable fragmentation has quite different effects in these two instruments. In a linear MALDI TOF instrument, although it has limited resolution and mass accuracy, it is much more tolerant of metastable fragmentation. This is because once the ions leave the short extraction region, they enter a field free drift chamber. If a metastable ion fragments in the drift tube the velocities of the fragments do not change significantly from the velocity of the original ion. Hence, the fragments will still arrive at the detector at the same time as the unfragmented ions, and there is little effect or degradation on the spectrum obtained.

In contrast, in a reflectron instrument, if metastable fragmentation occurs before or in the reflector, this will cause the fragment to spend a different time in the drift chamber before reaching the detector, causing significant degradation of the spectrum. It is for this reason that linear MALDI TOF is used where metastable fragmentation is perceived to be a potential problem.

As a first approximation, a linear MALDI TOF device can tolerate metastable fragmentation that occurs after a few microseconds (the time it takes for ions to leave the extraction region), while a reflectron MALDI device can only tolerate the metastable fragmentation that has a time scale of approximately 100 microseconds (the time when the ions leave the reflector); The time scale of metastable fragmentation usually depends on the level of internal excitation of the ions, the higher the degree of excitation the faster the ion will fragment.

Collisional cooling of MALDI ions as disclosed in published International Patent Application No. WO99/38185 can cure the problem of metastable fragmentation to some extent. In one preferred embodiment the ions are cooled down at a pressure ~10 mTorr. At this pressure the cooling time is about 100 $\mu$s. Thus, the fragmentation pattern in the spectra resembles the ones in Reflectron MALDI TOF, as some metastable fragmentation still occurs. The only difference is that the resolution and mass accuracy of the observed fragments in MALDI with collisional cooling stays the same as for the stable ions. Both fragments and primary ions leave the cooling stage cooled down and focused, prior to entry into the TOF section. As the ions are then cooled, no subsequent metastable fragmentation occurs in the TOF section.

As the cooling time is inversely proportional to the pressure another arrangement was disclosed in published International Patent Application No. WO99/38185. That arrangement has a cooling stage at a pressure of ~1 Torr. The cooling time in this case is ~1 As and this is short enough that fragmentation is substantially reduced. The spectra observed resemble the spectra from a linear MALDI TOF.

Unfortunately such a high pressure has the disadvantage that it can affect the ionization process resulting in cluster formation. Clusters of ions of interest with several matrix molecules begin to appear as the pressure increase. Since a typical MALDI sample has substances of interest embedded in the excess of the matrix molecules it has been speculated that the clusters represent the material that was cooled down too rapidly without allowing matrix molecules to "evaporate" from the analyte ions.

SUMMARY OF THE PRESENT INVENTION

Therefore, the present inventors have realized that it is a antageous to have a low pressure in the ionization region to permit complete "evaporation" of the matrix material and the release of desired analyte ions, a subsequent high-pressure region for rapid cooling of ions, and then again a low pressure region for mass analysis. Also, the first low pressure region and the high pressure region have to be close to each other because the velocity of the ions leaving the MALDI source is in the range of 1 mm/μs. Since the time interval between ionization and cooling has to be a few microseconds, the distance between the ionization surface and the high pressure region must be no more than a few millimeters. This invention proposes several embodiments of an apparatus to create such a sequence of low-high-low pressure conditions. In some other ionization sources (SIMS, FAB, EI, LA, for example) maintaining low pressure in the ionization region can be vital for the source operation. Thus, maintaining a low-high-low pressure profile can be important.

In accordance with a first aspect of the present invention, there is provided an apparatus comprising an ion source, a low-pressure region adjacent to the ion source providing conditions promoting generation of free ions, and downstream from the low-pressure region, a high-pressure region for cooling internally excited ions generated in the ion source.

In accordance with another aspect of the present invention, there is provided a method of generating a stream of ions, the method comprising the steps of:

(1) generating at an ion source a stream of ions of an analyte from a sample comprising die analyte and carrier material;

(2) subjecting the ions and any carrier material to a low-pressure region adjacent to the ion source, to promote release of the ions from the carrier material;

(3) subjecting the ions to a relatively high-pressure region downstream from the low-pressure region, to cool the ions.

BRIEF DESCRIPTION OF THE DRAWINGS

For a better understanding of the present invention and to show more clearly how it may be carried into effect, reference will now be made, by way of example of the accompanying drawings which show, by way of example, embodiments of the present invention and in which.

DETAILED DESCRIPTION OF THE INVENTION

Figure 1:
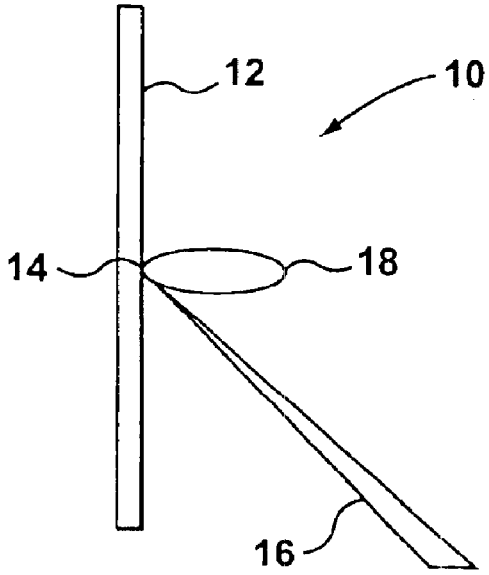
FIG. 1 is a schematic view indicating basic principles of generation of ions by MALDI.

Referring first to FIG. 1, this shows schematically the general arrangement for producing ions from a MALDI source indicated schematically at 10. In known manner, the source 10 includes a target probe 12, on which is located a MALDI sample 14. In known manners the MALDI sample 14 comprises a sample of analyte molecules, or which usually are large molecules and exhibit only moderate photon absorption for molecule embedded in a solid or liquid matrix consisting of a small, highly absorbing molecular species.

In use, a laser beam is provided as indicated at 16 and the laser is usually a pulsed laser. The sudden influx of energy, from each laser pulse, is absorbed by the matrix molecules of the sample 14, causing them to vaporize and to produce a small supersonic jet of matrix molecules and ions in which the analyte molecules are entrained. Such a jet of material is indicated schematically at 18. During this ejection process, some of the energy absorbed by the matrix is transferred to the analyte molecules.

The analyte molecules are thereby ionized, but without excessive fragmentation, at least in an ideal case. As noted, this technique can result in the analyte molecules being over-excited and acquiring a high degree of internal excitation, which can result in metastable fragmentation.

Figure 2:
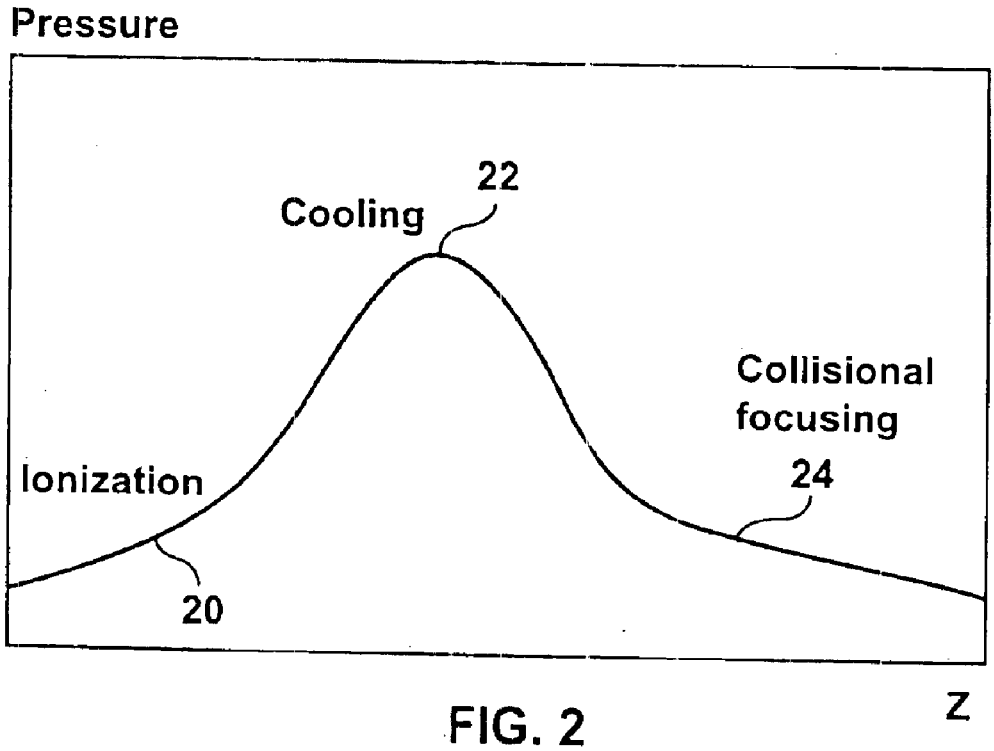
FIG. 2 is a schematic view showing an ideal pressure distribution along the axis from a MALDI ion source.

Referring to FIG. 2, this shows a variation of pressure on the vertical axis, with distance in the axial direction from the sample 14 indicated on the horizontal axis (the axial direction being a direction perpendicular to the plane of the target probe 12). As FIG. 2 shows, an ideal pressure profile has a first low pressure ionization region indicated at 20 where the pressure is relatively low ($10^{-7}$ to 10 Torr). This enables free expansion of the jet or plume 18 of vaporized material, permitting the ions to be released, and permitting the matrix material to evaporate and to dissipate, while minimizing formation of unwanted ions clusters. Immediately downstream from this region there is a high pressure, cooling region 22 maintained at a relatively high pressure ($10^{-2}$ to 1000 Torr), and configured to promote rapid cooling of analyte ions by collisional processes. The intention is to dissipate unwanted internal energy within the ions, so as to eliminate, or at least substantially reduce, the likelihood of metastable fragmentation.

Further downstream there is a collisional focusing region indicated at 24. The pressure here would be in the range of $10^{-3}$ to 10 Torr, and would be provided, typically, within a quadrupole or other multipole rod set or double helix ion guide or a set of rings ion guide. This collisional focusing region is intended to collect, collimate and focus ions, for subsequent processing. After collisional focusing, ions could be passed into the usual processing section of a mass spectrometer e.g. a mass analyzer section, collision cell, time of flight section and the like.

It will also be understood that while the pressure is shown as varying smoothly along the axis, this may not be the case and indeed may not be the best arrangement. For example, where anything in the nature of a lens or aperture in a wall is provided between two regions, this will eventually give a step-wise variation to the pressure profile and the pressure in each region may then be moved or less constant.

Reference will now be made to FIGS. 3–6, which shows different embodiments of an apparatus for implementing the present invention. All of these figures show the basic MALDI source, and for simplicity and brevity, the same reference numerals as used in FIG. 1 are used in FIGS. 3–6, and the description of these common and basic elements of a MALDI ion source is not repeated. Also, the references 20, 22, and 24, where applicable, are used to indicate different pressure regions in FIGS. 3–6, but it is to be understood that the pressure profile in each case will not correspond exactly with that shown in FIG. 2.

Figure 3:
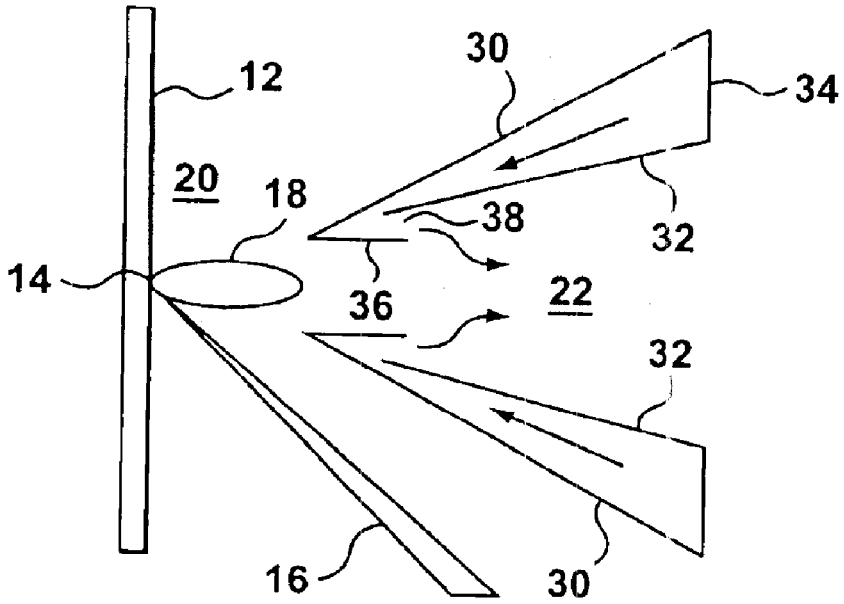
FIG. 3 shows a first embodiment of the present invention including a double cone arrangement for providing cooling gas flow.

Referring first to FIG. 3, a dual cone arrangement is provided, including an outer cone 30 and an inner cone 32.

The cones are closed off as indicated at 34. A short cylindrical section 36 is attached to the outer cone 30, so as to define between the cylindrical section 36 and the inner cone 32 and an annular outlet 38. The cones 30, 32, and the annular outlet 38 are all coaxial with an ion axis extending from the MALDI sample perpendicularly to the target probe 12, and provide a wall around a high pressure region.

Consequently, in use, as indicated by the arrows, an annular flow of gas is provided from the annular outlet 38 directed away from the jet or plume 18 of expanding, vaporized material. This ensures that adjacent the jet 18, there is a low-pressure region, as indicated at 20. The ions are liberated from the jet 18, and they then pass axially downstream and are entrained by the jet of gas from the annular outlet 38. This thus provides a cooling region 22 downstream from the outlet 38, at a relatively high pressure, in which ions are subject to collisional cooling processes to reduce their internal energy and thereby to reduce the likelihood of metastable fragmentation.

Figure 4:
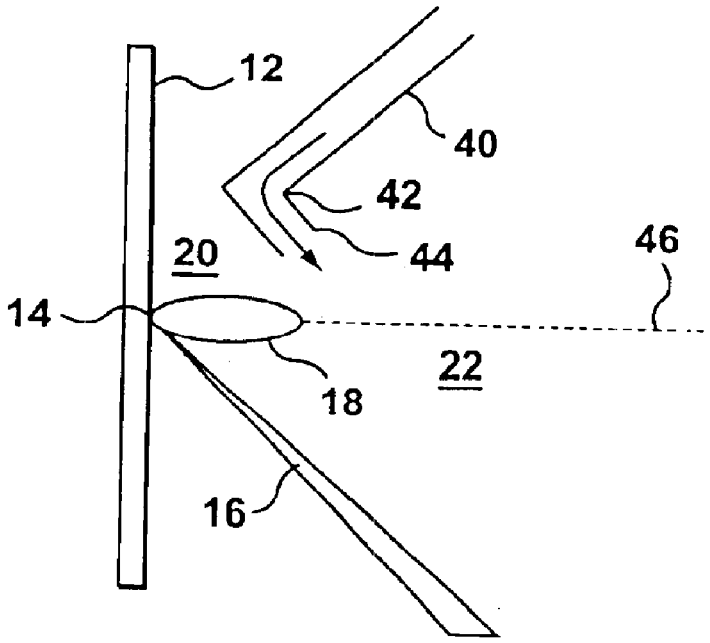
FIG. 4 shows a second embodiment including the provision of a high-density gas intersecting the ion path at an angle.

Referring to FIG. 4, in this embodiment, a cooling gas is supplied through a pipe or conduit 40, which includes a bend 42, that turns the gas flow through an angle towards an outlet 44. As shown, the outlet 44 is directed at an angle to intersect an axis for the flow of ions, indicated at 46.

Again, as for FIG. 3, this enables initial expansion of a jet 18 to occur in a low-pressure region 20. On the axis downstream from the jet 18, the ions then encounter the flow from the gas outlet 44 to provide a high-pressure cooling region 22, equivalent to the cooling region 22 of FIG. 2.

Figure 5:
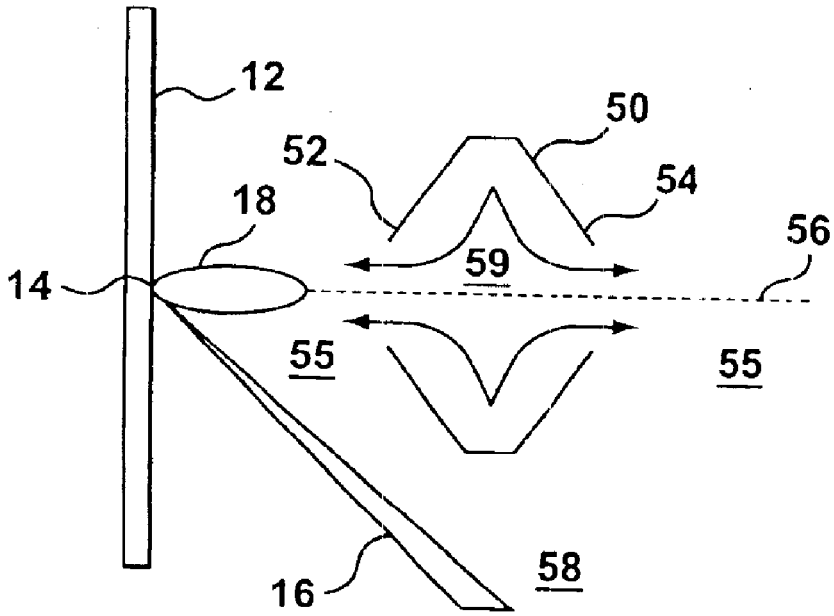
FIG. 5 shows a third embodiment including the separate high-pressure chamber with two outlets for gas.

Referring to FIG. 5, this shows a high-pressure chamber 50 which would be supplied with gas from an external source (not shown). The chamber 50 has first and second outlets indicated at 52 and 54, and both are provided on the axis 56.

The arrangement of FIG. 5 provides a more controlled definition of the cooling region, equivalent to cooling region 22 of FIG. 2 and here indicated at 59. Thus, the immediate surroundings outside of the housing 52, as indicated generally at 55 would be pumped down to a suitable pressure. This then defines at least the pressure for the initial cooling region. Within the chamber 52, the higher, cooling pressure 59 could be maintained, and gas would then flow axially out from the chamber 50 through the outlets 52, 54 as indicated by the arrows.

Figure 6:
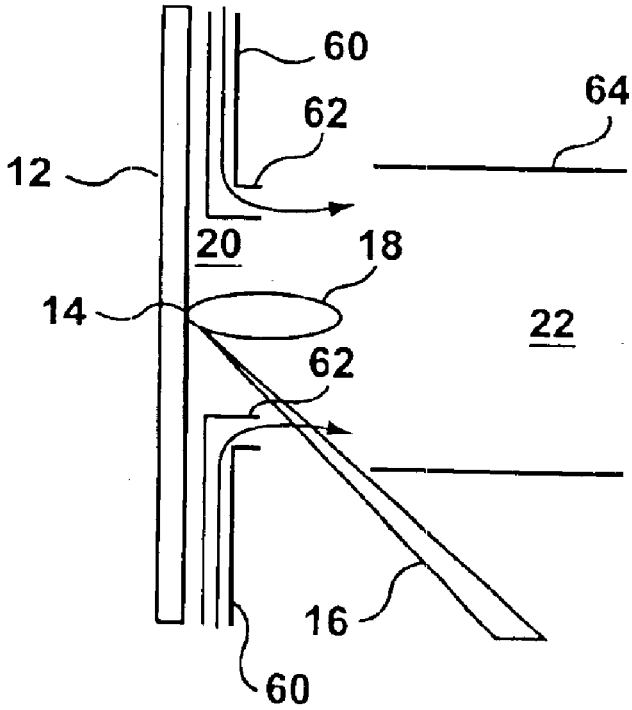
FIG. 6 shows a fourth embodiment including annular, ring-shaped outlet for cooling gas.

Referring to FIG. 6, the fourth embodiment of the present invention provides inlets for gas indicated at 60 connected to an annular gas outlet indicated at 62. This is directed inside a cylindrical sleeve 64.

Thus again in use, a relatively low-pressure region 20 would be provided around the jet 18. Immediately downstream from the jet 18, within the cylindrical sleeve 64, the vaporized material and ions would be entrained with the gas flow from the gas outlet 62, providing a cooling region 22 at a higher pressure. The flow of gas would then be drawn into a downstream region, e.g., the region 24 of FIG. 2, and where the pressure would be reduced and where collisional focusing could be provided. In some applications, the cylindrical sleeve 64 may be omitted if required pressure regimes and available pumping speed allow so.

Also, the embodiments shown here (FIGS. 3, 4, 5, and 6) have the pressure profile generating elements separate from the MALDI target. But, it is anticipated that in some circumstances the pressure profile generating elements can be completely or partially associated with the target, i.e. more or less integral with the ion source.

It should also be noted that, while the arrangements of FIGS. 3,4,5,6 show the axis of the ionization region coaligned with the axis of the elements determining the required pressure profile and with the axis which would define any following ion guide, this need not always be the rule; in some cases, there may be an advantage to have these axes tilted or even slightly offset with respect to each other, i.e. there could be a first ion axis portion extending from the ion source and a second ion axis portion extending at least through the high pressure region and preferably into a downstream ion guide, with these two ion axis portions at an angle to one another and/or offset relative to one another. Such an arrangement may facilitate separation of ions from neutrals and heavy charged clusters formed in the ion source. The ions will be drawn into the ion guide by the gas flow and/or electrostatic forces while neutrals and heavy clusters will pass away from the ion guide, generally along the axis of the first ion axis portion.

Figure 7:
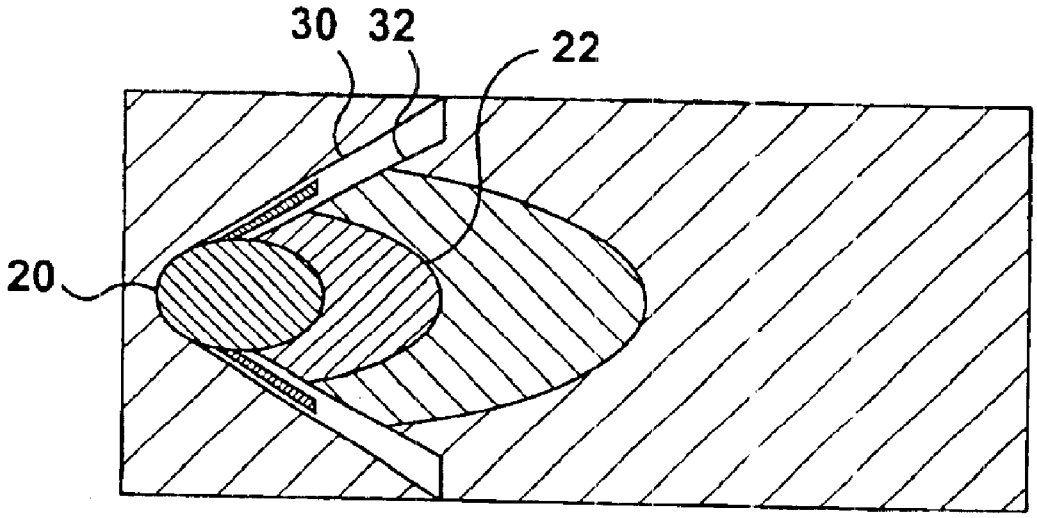
FIG. 7 shows a gas dynamic simulation of the apparatus of FIG. 3.

Referring to FIG. 7, this shows the result of direct gas dynamic simulations that shows gas density distributions in the apparatus of FIG. 3. For simplicity and brevity, the same components in FIG. 7 are given the same reference as in FIG. 3 and the descriptions of these components are not repeated. A low pressure region is visible at 20; the high 22 is indicated by the darker shading; and further downstream there is a lower pressure region, where collisional cooling occurs.

Figure 8A:
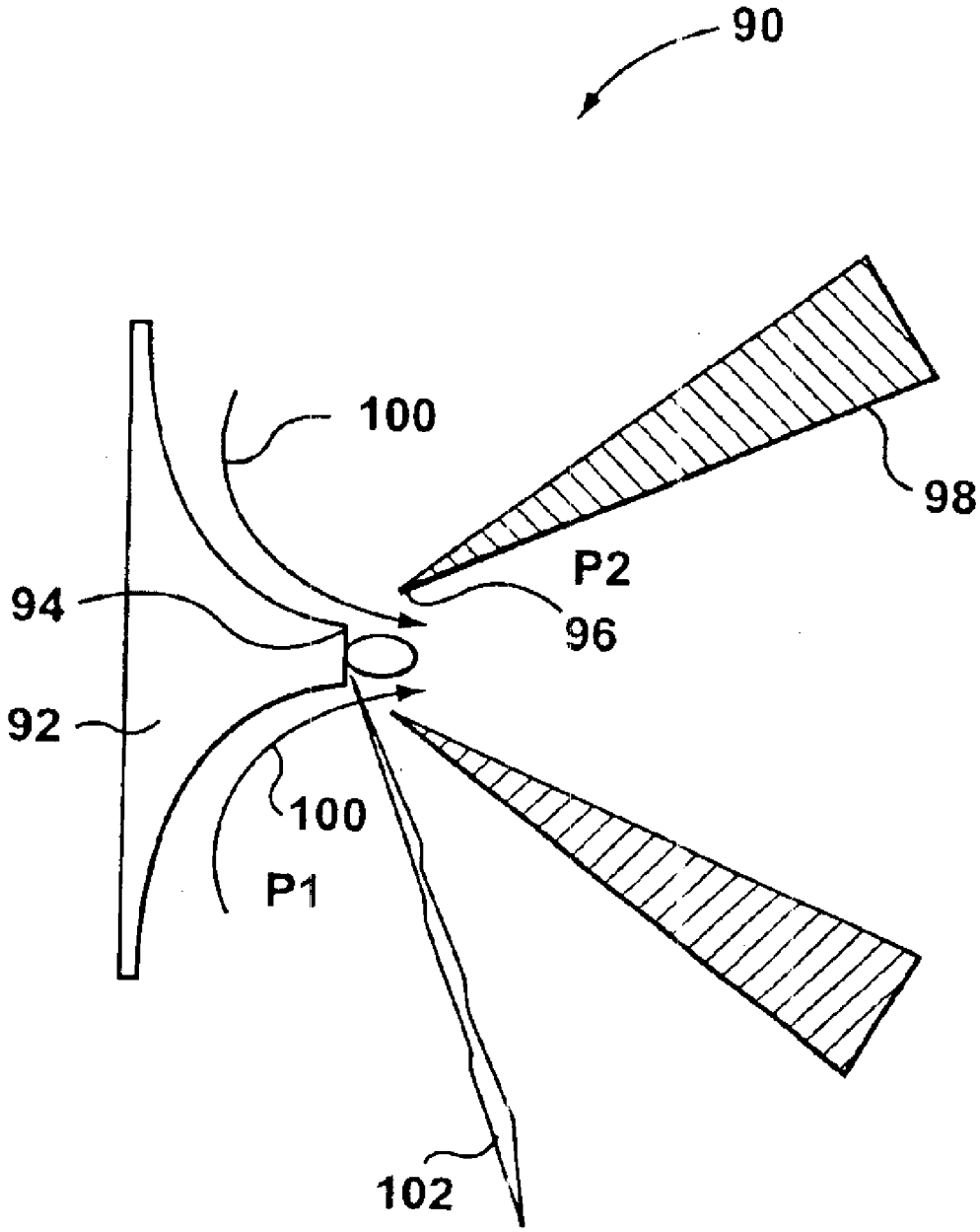
FIGS. 8*a*, 8*b* and 8*c* show three variants of a fifth embodiment of the present invention.
Figure 8B:
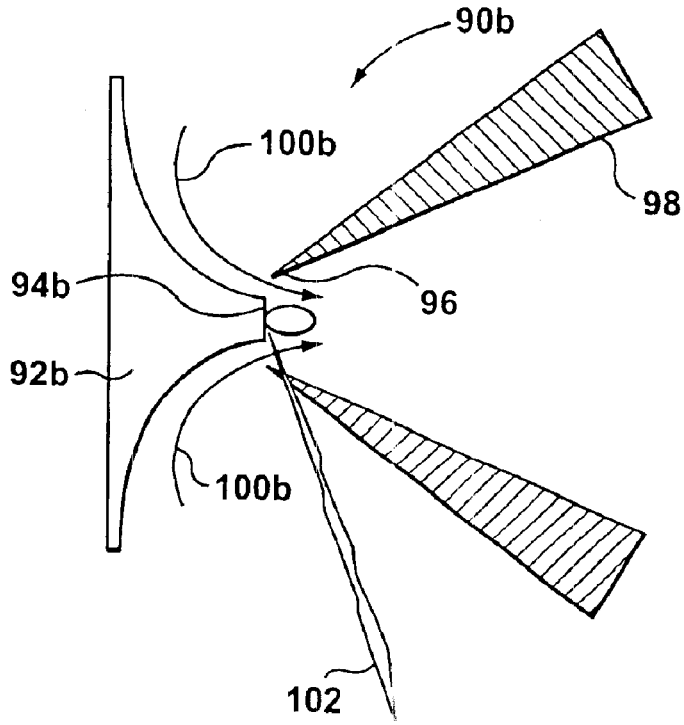
Figure 8C:
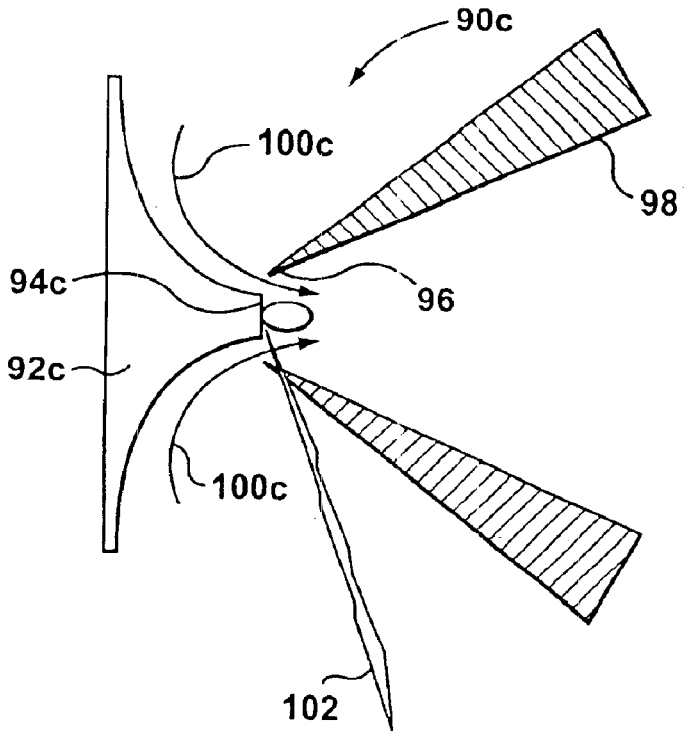

Reference will now be made to FIGS. 8*a*, 8*b*, and 8*c*, which show a fifth embodiment of the present invention. This embodiment is based on the realization that, once the supersonic jet of matrix molecules and ions is formed, there is a tendency for the jet to expand or spread in all available directions, although the main trajectory tends to be orthogonal to the surface of the target probe. If the distance that the jet travels before it enters the cooling region is significant, or if the opening of the ion transmission path (skimmer orifice) is small compared to the diameter of the expanding jet, a significant portion of the analyte molecules may not be detected.

Thus, in FIG. 8*a*, to overcome this difficulty, a fifth embodiment of the invention, indicated generally at 90, is shown. This embodiment includes a cone-shaped target probe 92. The target probe 92 would, in a section perpendicular to the axis of the device, have a circular section. The probe 92 has a circular MALDI surface 94, located coaxial with an opening or orifice 96 in a sampling cone or skimmer 98, the cone 98 being similar to earlier embodiments. An ionization region P1 outside the cone 98 has a pressure that is generally greater than the pressure P2 within the cone. A MALDI sample is located on the MALDI surface 94 and is ionized with a laser 102.

Consequently, there is a flow of gas from the relatively high-pressure ionization region to the interior of the sampling cone or skimmer 98, as indicated by the arrows 100. These arrows 100 show, schematically, streamlines representative of gas flow, and indicate how the gas flow follows the profile of the target probe 92. This gas flow entrains the jet of molecules and ions from the MALDI sample and transfers the plume through the skimmer opening or orifice 96 into the skimmer or cone 98.

The entrainment has the effect of confining the plume to prevent spreading of the plume. In contrast, in the earlier embodiments, the MALDI sample is on a flat surface so that there will be no strong confining flow immediately adjacent to the sample itself.

FIG. 8*a* shows the MALDI sample surface 94 positioned outside of the sampling cone 98, i.e. just upstream of the inlet 96. It is possible that the MALDI sample surface 94 could be provided in different locations relative to the cone 94, and alternative configurations are shown in FIGS. 8*b* and 8*c*. For simplicity and brevity in these figures, the same reference numerals are used, with suffixes "b" "c", to distinguish them from FIG. 8*a*.

Thus, a second variant, 90*b*, in FIG. 8*b* has the target probe 92*b* positioned such that the sample surface 94*b* is now located generally coplanar with the opening or orifice 96. In FIG. 8*c,* the variant is indicated at 90*c* and here a cone-shaped target probe 92*c* has its MALDI sample surface 94*c* positioned just inside the opening 96.

Streamlines are indicated in FIGS. 8*b* and 8*c* by arrows 100*b* and 100*c* respectively, to indicate gas flow. Again, these are schematic, and the detailed gas flows will vary slightly between the variants of FIGS. 8*a*, 8*b* and 8*c*.

Figure 9A:
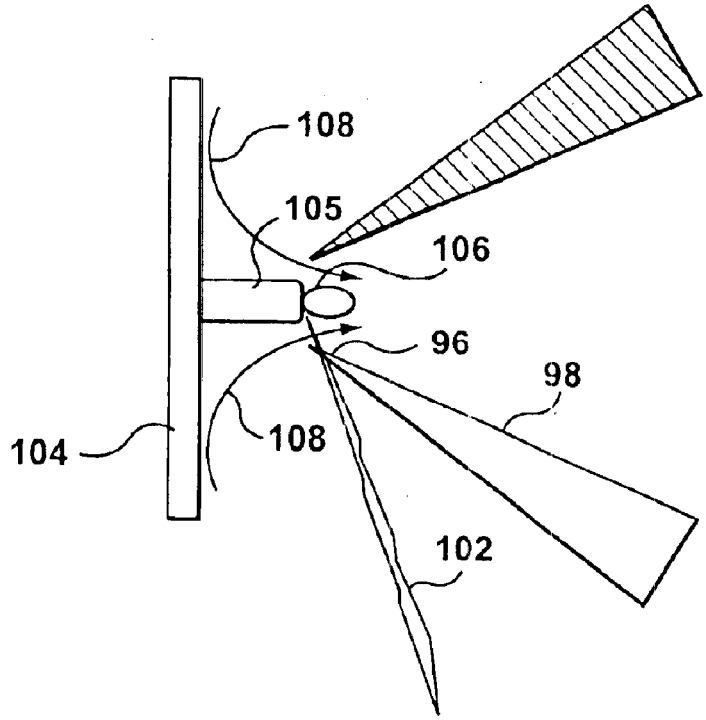
FIGS. 9*a*, 9*b* and 9*c* show a further variant of the fifth embodiment of the present invention, showing multiple sample spots.

A further, simple alternative is shown in FIG. 9*a*. Here, the skimmer or cone is again indicated at 98 and has the opening orifice 96. The laser beam is again indicated schematically 102.

In FIG. 9*a,* in place of the cone-shaped target probe, the is provided a post 105 mounted on a planar support 104. The post 195 includes an end surface 106, providing a MALDI support surface, for a MALDI sample. The post 105 is of sufficient length, to enable streamlines to develop to entrain the flow, as indicated by the arrows 108. It is expected that this arrangement will give similar advantages to the configurations of FIGS. 8*a, b* and *c,* while providing a structurally simpler arrangement for the target probe.

Figure 9B:
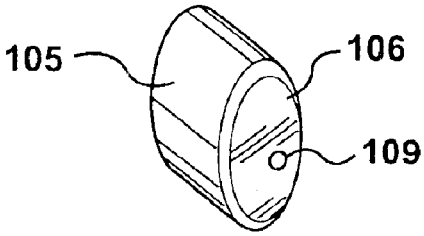
Figure 9C:
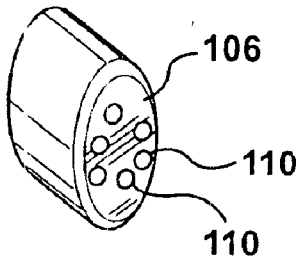

It is preferred for the post 105 to be generally circular, but it could have other profiles. For example, FIGS. 9*b* and 9*c* show generally elliptical cross sections for the post 105. As indicated schematically in FIGS. 9*a* and 9*b,* the MALDI support surface 106 can be used for just a single MALDI sample 109 or a number of separate samples 110, as shown in FIG. 9*c*.

It is preferred for the post 105 and the end of the cone-shaped target probe 92 not to have any sharp edges, so as to permit continuous, smooth gas flow, without any unwanted turbulence. Thus, in FIGS. 9*a,* 9*b* and 9*c,* the post 105 is shown with generally rounded edges to the surface 106.

Figure 10A:
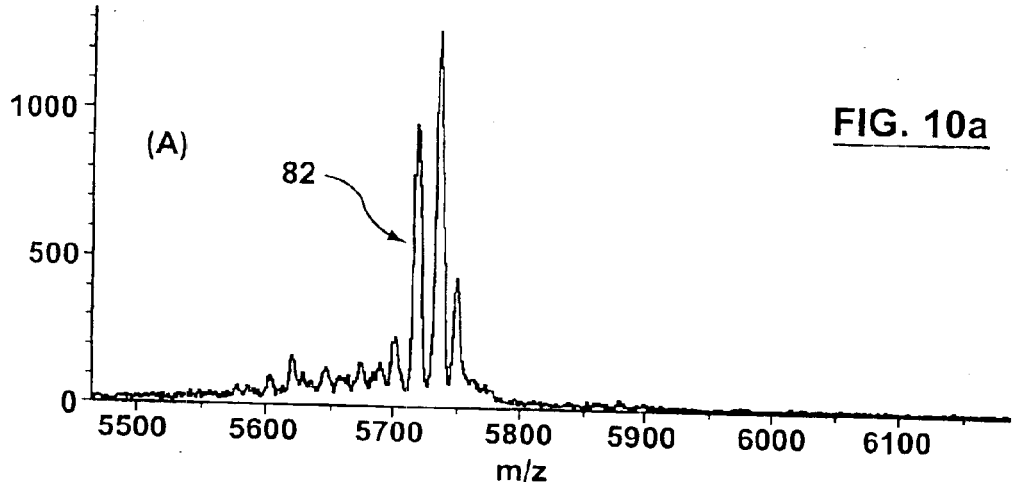
FIG. 10*a*, 10*b* and 10*c* are mass spectra of insulin, showing the effect of different ion source conditions.
Figure 10B:
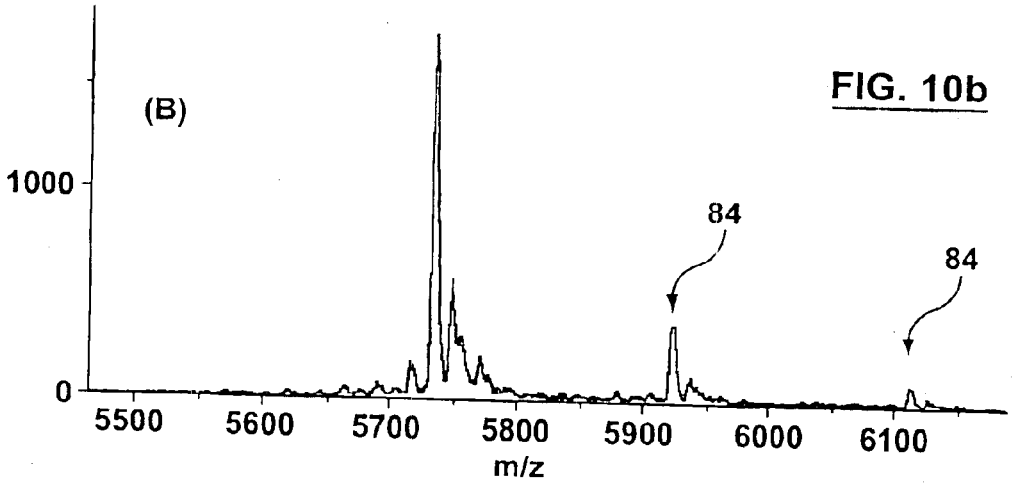
Figure 10C:
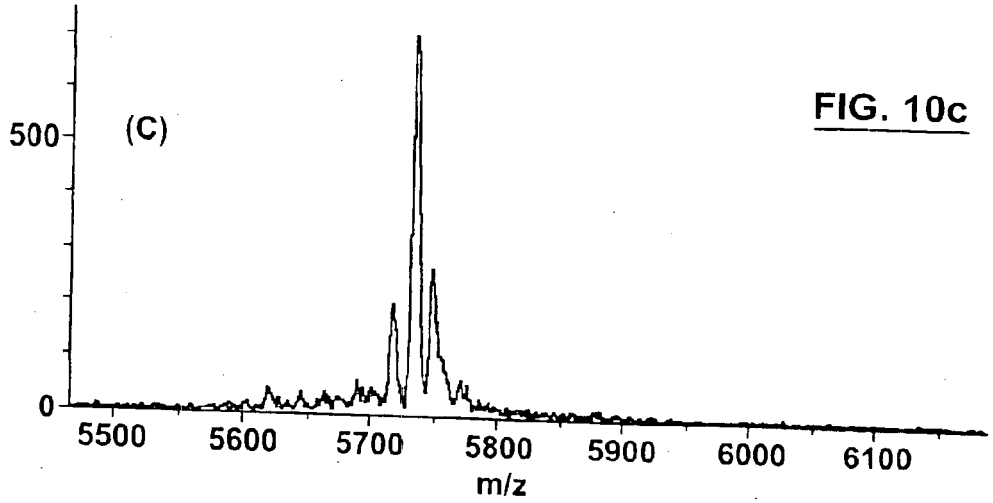

Referring to FIG. 10, MALDI spectra of insulin are shown for different ion source conditions. FIG. 10*a* shows spectra for a low pressure of approx. 8 mTorr in the ionization region. FIG. 10*b* shows spectra for a high pressure of approx. 1 Torr in the ionization region 20, while FIG. 10*c* shows spectra for a configuration as in FIG. 2 (i.e., low pressure ionization region 20, higher pressure cooling region 22 and low pressure collisional focusing region 24) and using the configuration of FIG. 3. In FIG. 10*a,* fragment ions 82 are abundant, showing the benefit of higher pressure. In FIG. 10*b,* analyte-matrix cluster ions 84 are abundant; emphasizing the necessity of low pressure during initial stage of MALDI. The flow of gas can be supplied to all of the above embodiments continuously or in pulsed fashion. Pulsed gas introduction may be beneficial to reduce pumping speeds required for the setup because the average gas load will be reduced. Alternatively, higher peak pressures can be obtained with pulsed gas flow in the setup designed or continuous gas introduction. The pulse of gas will be provided the means of a pulsed valve or similar device. The opening of the valve will be synchronized with ionization event allowing certain delays for ionization to occur and for gas pressure to rise to a desired level.

The pressures in sections 20 and 24 may not be equal. A wall can be added to separate the above sections for arrangements from FIGS. 3, 5 and 6. An extra pumping can be provided to obtain desired pressures in sections 20 and 24.

What is claimed is:

1. An apparatus comprising:

an ion source;

a low-pressure region adjacent to the ion source providing conditions promoting generation of free ions;

and immediately downstream from the low-pressure region, a high-pressure region for cooling internally excited ions generated in the ion source.

2. An apparatus as claimed in claim 1, wherein the ion source comprises a pulsed ion source.

3. An apparatus as claimed in claim 2, wherein the pulsed ion source comprises: matrix assisted laser desorption ionization source including target probe and a source of radiation.

4. An apparatus as claimed in claim 1 wherein the ion source comprises one of the following ions sources: Surface ionization mass spectrometry (SIMS). Fast atom bombardment (FAB); Laser Ablation (LA); Elect impact (EI); Metastable atom bombardment (MAB) and Desorption-ionization on silica (DIOS).

5. An apparatus as claimed in claim 3, wherein the source of radiation comprises a pulsed laser.

6. An apparatus as claimed in claim 1, wherein the apparatus includes an ion path having a ion axis extending away from the ion source, and wherein the high-pressure region comprises a housing defining the high-pressure region and having outlets located on the ion axis to permit passage of ions through the housing, and means for supplying gas to the housing.

7. An apparatus as claimed in claim 6, wherein elements defining the high-pressure region at least are integral with the ion source.

8. A method of generating a stream of ions, the method comprising:

(1) generating at an ion source a stream of ions of an analyte from a sample comprising the analyte and carrier material;

(2) subjecting the ions and any carrier material to a low-pressure region adjacent to the ion source, to promote release of the ions from the carrier material;

(3) subjecting the ions to a relatively high-pressure region immediately downstream from the low-pressure region, to cool the ions.

9. A method as claimed in claim 8, which includes providing the analyte in a liquid carrier material.

10. A method as claimed in claim 8, which includes providing the analyte in a solid carrier material.

11. A method as claimed in claim 9 or 10, which includes providing the sample, comprising the carrier material and the analyte, on target probe, and radiating the sample to cause vaporization of the carrier material and the analyte.

12. A method of generating a stream of ions, the method comprising:

(1) generating at an ion source a stream of ions of an analyte from a sample comprising the analyte and carrier material;

(2) subjecting the ions and any carrier material to a low-pressure region adjacent to the ion source, to promote release of the ions from the carrier material;

(3) subjecting the ions to a relatively high-pressure region downstream from the low-pressure region, to cool the ions (4) providing a sample on a target probe and irradiating this sample to generate the stream of ions; and (5) providing the target probe with a profile promoting formation of streamlines around the sample probe and generally parallel the axis of the sample probe to entrain a plume of molecules and ions generated from the source retain forming the stream of ions.

13. A method of generating a stream of ions as claimed in claim 12, wherein the high-pressure region is immediately downstream from the low-pressure region.

14. A method as claimed in claim 12, which includes providing the target probe with a generally conical shape.

15. A method as claimed in claim 12, which includes providing the target probe with a substantially constant cross-section.

16. A method as claimed in claim 12, which includes providing a skimmer cone and locating the sample surface of the target probe at one of: a location outside the skimmer cone upstream orifice thereof, generally coplanar within the orifice; and downstream from the orifice within the skimmer.

17. A method as claimed in claim 12, which includes providing a plurality of samples on the sample surface.

18. A method as claimed in claim 14, which includes irradiating the sample with a pulsed laser.

19. A method as claimed in claim 14, which includes providing a pressure in the range of $10^{-7}$ to 10 Torr in the low-pressure region, and which includes collisional focusing the ions at a pressure in the range $10^{-3}$ to 10 Torr.

20. A method as claimed in claim 19, which include providing a pressure in the range $10^{-2}$ to 1000 Torr, in the high-pressure region.

21. A method as claimed in claim 14 or 19, which includes, after cooling the ions in step 3, subjecting the ions to collisional focusing at a pressure lower than the pressure in step (3).

22. A method as claimed in claim 21, which includes collisional focusing the ions at a pressure in the range $10^{-3}$ to 10 Torr.

23. A method as claimed in claim 21, which includes collisional focusing the ions in a multipole rod-set or a double helix ion guide or a set of rings ion guide.

24. A method as claimed in claim 21, which includes, after focusing the ions, subjecting the ions to mass analysis.

25. A method as claimed in claim 24, wherein the mass analysis step comprises mass selecting a precursor ion, and wherein the method further comprises subjecting the precursor ion to one of collision and reaction with a gas to generate product ion ions, and subsequently mass analyzing the product ions.

26. An apparatus comprising:

a pulsed ion source having a matrix assisted laser desorption ionization source including a target probe and a source of radiation, the target probe including a sample surface for the matrix assisted laser desorption ionization source, and the target probe is shaped to promote formation of streamlines around the target probe and generally parallel to the axis of the target probe, to entrain a plume of molecules and ions generated from the source in use;

a low-pressure region adjacent to the ion source providing conditions promoting generation of free ions;

and downstream from the low-pressure region, a high-pressure region for cooling internally excited ions generated in the ion source.

27. An apparatus as claimed in claim 26, wherein the target probe has a generally conical shape.

28. An apparatus as claimed in claim 26, wherein the target probe includes a post of substantially constant-cross section.

29. An apparatus as claimed in claim 26, wherein the apparatus includes a skimmer cone having an orifice, and wherein the sample surface is located at one of: a location outside the skimmer cone upstream from the orifice thereof; generally coplanar with the orifice; and downstream from the orifice within the skimmer.

30. An apparatus as claimed in claim 26, wherein the sample surface provides locations for a plurality of separate samples.

31. An apparatus as claimed in claim 26, wherein the high-pressure region is immediately downstream from the low-pressure region.

32. An apparatus comprising:

an ion source;

a low-pressure region adjacent to the ion source providing conditions promoting generation of free ions;

downstream from the low-pressure region, a high-pressure region for cooling internally excited ions generated in the ion source; and an ion path having an axis extending away from the ion source, at least one wall in the high-pressure region extending substantially around the ion path and, in the high-pressure region, an outlet providing a jet of gas to maintain the pressure in the high-pressure region, the outlet being directed away from the ion source and into the high pressure region.

33. An apparatus as claimed in claim 32, wherein the outlet is substantially annular.

34. An apparatus as claimed in claim 32, wherein the ion path comprises a first ion axis portion extending away from the ion source and a second ion axis portion extending through the high pressure region at least, wherein the first and second ion axis portions are at an angle to one another or offset with respect to one another.

35. An apparatus as claimed in any one of claims 32 to 34, wherein elements defining the high pressure region at least are integral with the ion source.

36. An apparatus as claimed in claim 32 or 33, which includes means for supplying gas to each outlet as a series of gas pulses.

37. An apparatus as claimed in claim 32, wherein the high-pressure region is immediately downstream from the low-pressure region.

38. An apparatus comprising:

an ion source;

a low-pressure region adjacent to the ion source providing conditions promoting generation of free ions;

downstream from the low-pressure region, a high-pressure region for cooling internally excited ions generated in the ion source;

an ion path having an axis extending away from the ion source;

and the high-pressure region includes a conduit for gas having an outlet directed towards the ion axis and away from the ion source.

39. An apparatus as claimed in claim 38, which includes means for supplying gas to each outlet as a series of gas pulses.

40. An apparatus as claimed in claim 38, wherein elements defining the high-pressure region at least are integral with the ion source.

41. An apparatus as claimed in claim 38, wherein the high-pressure region is immediately downstream from the low-pressure region.

42. An apparatus comprising:

an ion source;

a low-pressure region adjacent to the ion source providing conditions promoting generation of free ions;

downstream from the low-pressure region, a high-pressure region for cooling internally excited ions generated in the ion source; and an ion path having an axis extending away from the ion source, the high-pressure region having at least one wall around the ion axis defining the high-pressure region, and at least one gas jet having an outlet directed into the high-pressure region and away from the ion source.

43. An apparatus as claimed in claim 42, wherein said least one jet comprises an annular jet having an annular outlet located around the low pressure region and directed parallel to the axis into the high-pressure region.

44. An apparatus as claimed in claim 42 or 43, which includes means for supplying gas to each outlet as a series of gas pulses.

45. An apparatus as claimed claim 42 or 43, wherein elements defining the high-pressure region at least are integral with the ion source.

46. An apparatus as claimed in claim 42, wherein the high-pressure region is immediately downstream from the low-pressure region.

47. An apparatus comprising;

an ion source;

a low-pressure region adjacent to the ion source providing conditions promoting generation of free ions;

downstream from the low-pressure region, a high-pressure region for cooling internally excited ions generated in the ion source;

an ion path having a ion axis extending away from the ion source, and the high-pressure region comprises a housing defining the high-pressure region and having outlets located on the ion axis to permit passage of ions through the housing; and means for supplying gas to the housing, the means for supplying gas including means for supplying a series of gas pulses.

48. An apparatus as claimed in claim 47, wherein the high-pressure region is immediately downstream from the low-pressure region.

* * * * *